US006623105B1

(12) United States Patent
Shen

(10) Patent No.: US 6,623,105 B1
(45) Date of Patent: Sep. 23, 2003

(54) PRINTHEAD CARTRIDGE LATCHING ASSEMBLY

(75) Inventor: Jingsong Alan Shen, Walnut, CA (US)

(73) Assignee: Addmaster Corporation, Monrovia, CA (US)

( * ) Notice: Subject to any disclaimer, the term of this patent is extended or adjusted under 35 U.S.C. 154(b) by 0 days.

(21) Appl. No.: 09/930,587

(22) Filed: Aug. 15, 2001

(51) Int. Cl.[7] ..... B41J 2/01
(52) U.S. Cl. ..... 347/49
(58) Field of Search ..... 347/49, 85, 86, 347/87, 39

(56) References Cited

U.S. PATENT DOCUMENTS 4,755,836 A 7/1988 Ta et al. ..... 347/49
4,907,018 A 3/1990 Pinkerpell et al. ..... 346/139 R
5,579,039 A * 11/1996 Kurata et al. ..... 347/49
5,847,731 A * 12/1998 Kashimura et al. ..... 347/49
6,170,940 B1 * 1/2001 Shinada et al. ..... 347/86
6,250,750 B1 * 6/2001 Miyazawa et al. ..... 347/87
6,386,681 B1 * 5/2002 Askren et al. ..... 347/49

OTHER PUBLICATIONS

"Programs Guide," ITHACA, POSjet 1000, Receipt Printer, PN: 12–00243, Rev. B, Jun. 2000, (2 pages).

* cited by examiner

*Primary Examiner*—Michael Nghiem
(74) *Attorney, Agent, or Firm*—Christie, Parker & Hale, LLP

(57) ABSTRACT

Apparatus for holding and securing a printer cartridge to a printer that is easy to use and manipulate. The apparatus utilizes a number of mechanical features including cams and pivoting pins to move the cartridge axially so that the cartridge contacts a contact strip and exert force on the cartridge in a generally downward direction to secure the cartridge from moving. Preferred methods for assembling and using the apparatus are disclosed.

25 Claims, 6 Drawing Sheets

FIG. 6
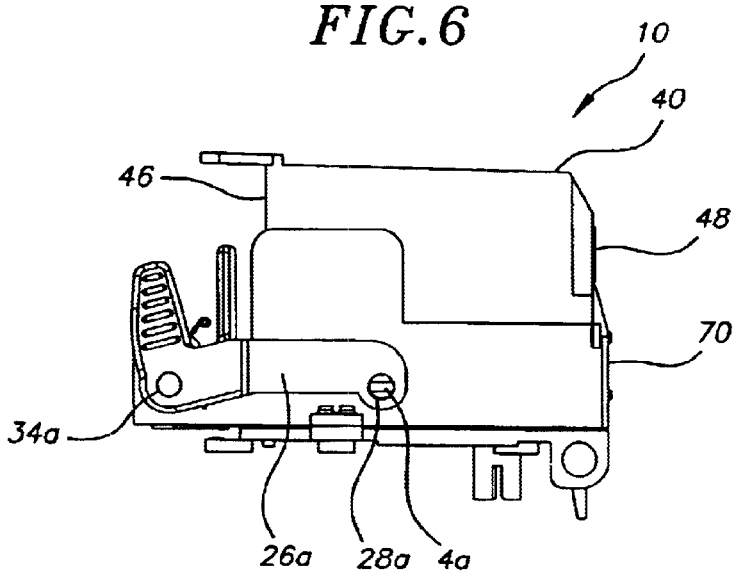
FIG. 7
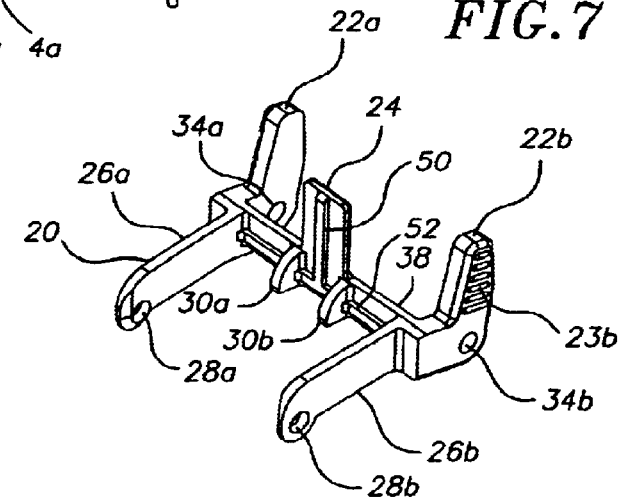
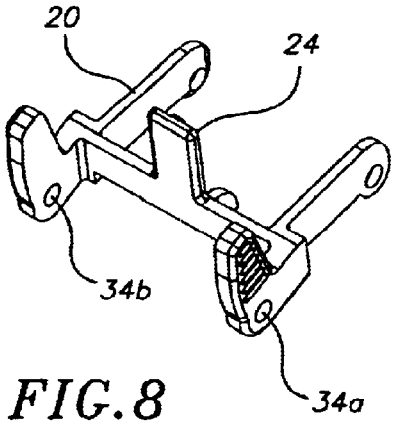
FIG. 8

PRINTHEAD CARTRIDGE LATCHING ASSEMBLY

This invention generally relates to latching mechanisms with locking detents, cams, and pivoting positions to align and secure a first member to a second member, and specifically to a latching mechanism for a printhead carriage assembly.

BACKGROUND OF THE INVENTION

Point of sale (POS) printers for institutions such as banks have been available for years. For printing, some of these earlier printers have been known to use thermal paper or non-pigmented ribbon inks. More recently, inkjets have found their ways to the POS market with great success. Unlike a typical black ink ribbon which starts out printing dark characters (i.e., high density) and then fades over time, an inkjet printer maintains a consistent print, even until the end.

However, while POS inkjet printers have been manufactured for years by a number manufacturers, including Addmaster, the assignee of the current invention, inkjet cartridges, inkjet pens, or inkjet printheads (herein printheads) are supplied primarily by Hewlett-Packard. Thus, as a practical matter, original equipment manufacturers (OEMs), such as Addmaster, will manufacture their own proprietary printer components with the exception of printheads, wherein they will generally turn to Hewlett-Packard for supply.

But as needs, costs, and/or other factors from time to time change, so too will printhead designs. Whenever this occurs, OEMs face a corresponding need to modify their carriages to accommodate these new designs, whether by Hewlett-Packard or otherwise.

SUMMARY OF THE INVENTION

The present invention provides a new and unique apparatus and method for securing a printhead to a carriage (or carrier) that is easy and convenient to use. The preferred embodiment includes a carriage with latching mechanism that has at least one cam and locking tab to position the printhead and to secure same within the carriage.

In one preferred embodiment, the carriage is configured to accept the printhead, move the printhead from a first position to engage a corresponding contact pad on the carriage, and then exert a force along an opposing end to secure it within the carriage in a secured second position. Among several options, this is accomplished by providing a latching mechanism with a back plate having at least one cam to both move the printhead and then firmly secure same to the carriage (by engaging with one of the printhead surfaces).

To ensure a somewhat permanent and locked second position until released, engagement detents are provided. These engagement detents are configured to lock the latching mechanism against the carriage's housing by providing a grabbing surface, such as tabs or ears, for the latching mechanism to engage with. Once secured, the backplate must be intentionally unlatched by releasing the engagement detents. As further discussed below, two additional tabs are incorporated, which are squeezed together to cause the latching mechanism to disengage from the detents.

Another embodiment of the present is a latching mechanism having spring loaded engagement arms to further force the latching mechanism away from the chute, to provide clearance therein for the replacement printhead.

These, as well as other objects and advantages of the present invention will be apparent from the following specification and the accompanying drawings, which are for the purpose of illustration only. Furthermore, it is understood that changes in the specific structure shown and described may be made within the scope of the claims without departing from the spirit of the invention.

BRIEF DESCRIPTION OF THE DRAWINGS

FIG. 6 is similar to FIG. 5, but with the printhead in a latched position;

FIG. 7 is an isometric view of the latching mechanism;

FIG. 8 is similar to FIG. 7, but viewed in the opposite direction;

DETAILED DESCRIPTION OF THE INVENTION

Figure 1:
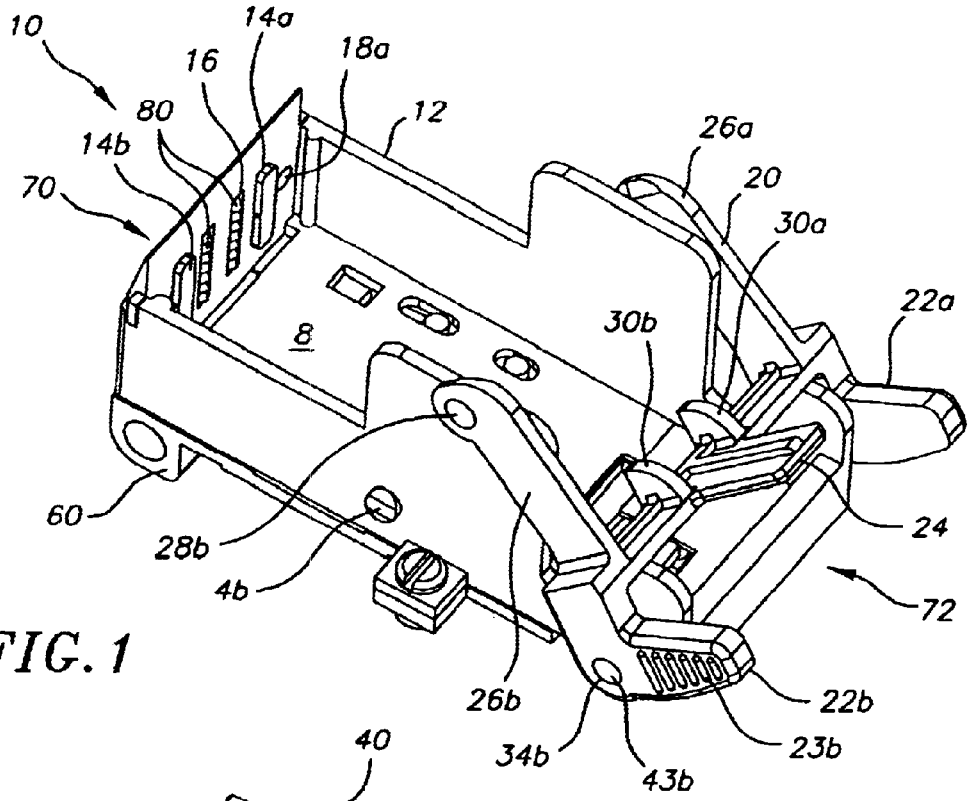
FIG. 1 is an isometric view of a preferred embodiment of the invention.

The detailed description set forth below in connection with the appended drawings is intended as a description of the presently preferred embodiment of the invention and is not intended to represent the only form in which the present invention may be constructed or utilized. The description sets forth the functions and the steps for constructing and operating the invention in connection with the illustrated embodiment. It is to be understood, however, that the same or equivalent functions and structures may be accomplished by different embodiments that are also intended to be encompassed within the spirit and scope of the invention.

The drawings illustrate a preferred embodiment of the invention, including a carriage and a multi-action latching mechanism. Preferably, the components of the carriage are fabricated from suitably strong, lightweight materials to provide reliable service in POS printers and are easy to manipulate and use. Many of the components may be fabricated by injection molding. Preferably, most of the mechanical components of the invention are injection molded from glass-filled reinforced ABS, other equivalent plastic products, or fabricated by some similar process so long as it provides the latching function described herein, including machined from aluminum or other related materials. Persons of ordinary skill in the art will understand that the invention may be effectively practiced with a wide variety of materials and fabrication methods. Moreover, while the invention is described with specificity for POS printers, the same may be used for printers in other industries and for securing other non-inkjet type cartridges, including printers for personal computers, laser printer cartridges, top loaded printheads, etc. As denoted herein, drawings with similar features are designated with similar numbers for consistency.

FIGS. 1–6 illustrate a preferred carriage 10 having a body section 12 and a latching mechanism 20 cooperatively engaged to provide the objects of the present invention. FIGS. 7–11 depict the preferred latching mechanism 20 in various views. Finally, FIG. 12 illustrates a typical installation of the preferred embodiment (FIGS. 1–11) in printer 70 with front 74 and rear 72 covers removed and the center hardware 82 exposed. The hardware includes a print tape (not shown), the carriage assembly 10, and various electronic components 84 (which are not essential to the present invention and will not further be discussed).

As a general overview, the printer 70 (FIG. 12) receives a print command from a computer or a logic controller. It then directs the carriage 10 to move back and forth along front rod 76 and rear guide rail 78 while printing or producing some desired output, namely print characters on print tape (not shown), via nozzles located in printhead 40. Although the printer is shown with a horizontally mounted printhead 40, as further discussed below, other configurations are contemplated and are understood to fall within the scope of the present invention, including a vertically mounted printhead.

Referring now to FIG. 1 for a more detailed description of the preferred carriage. The carriage 10 includes a base 60 fixedly adhered to the body 12, along a corresponding set of ears 90*a*, 90*b*. Preferably, the ears are secured together by screws, however, as understood by persons of ordinary skill in the art, detents, rivets, glue, or other engagement means may be used to assemble the components without deviating from the scope of the invention.

Figure 3:
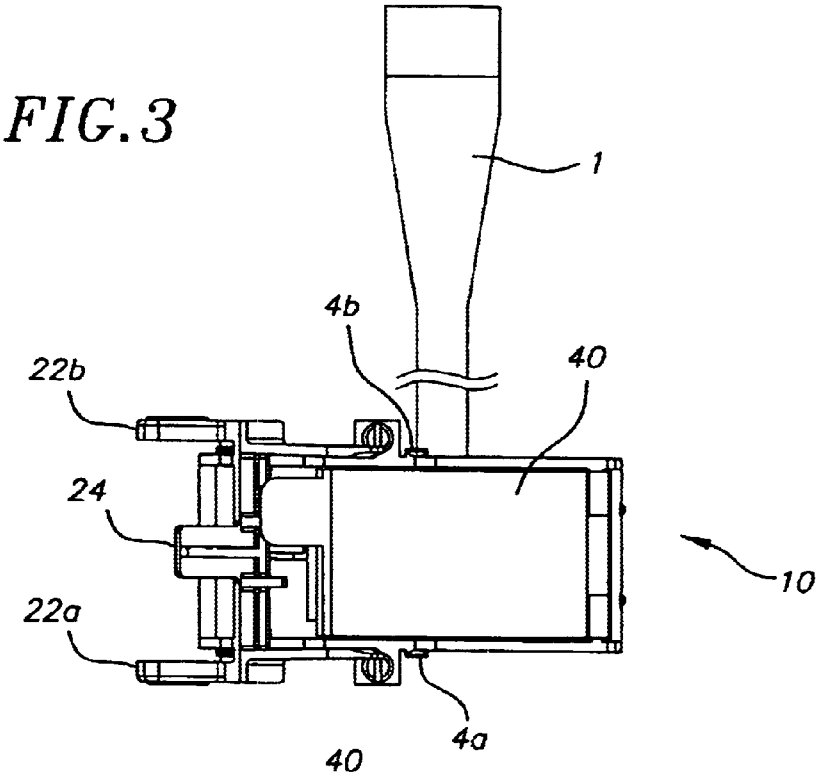
FIG. 3 is a top plan view of FIG. 2, but in an unlatched position and includes reference to an interconnect strip.
Figure 4:
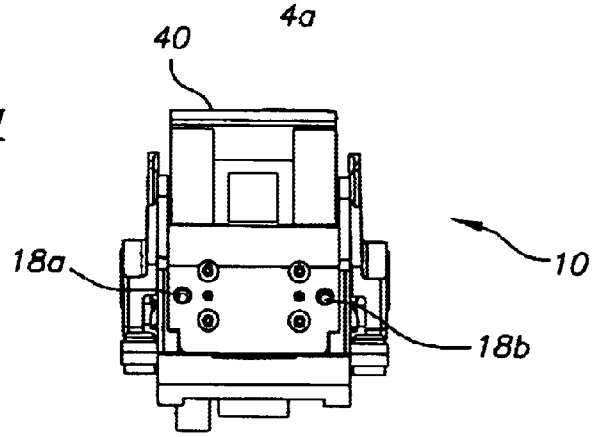
FIG. 4 is a front elevation view of FIG. 3, but without the interconnect strip.
Figure 5:
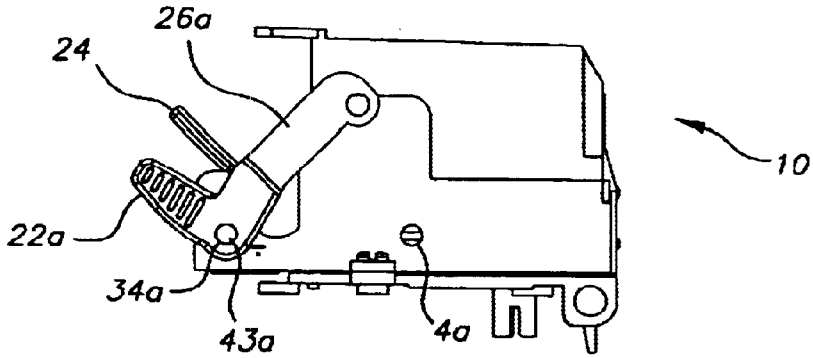
FIG. 5 is a side elevation view of FIG. 4.
Figure 9:
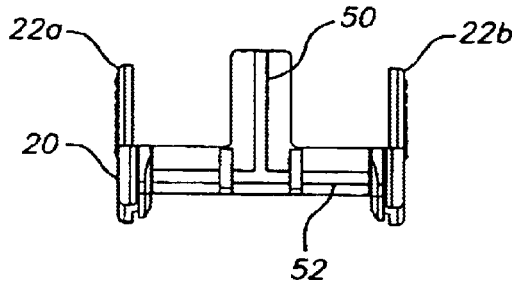
FIG. 9 is a front elevation view of FIG. 7.

The front end 70 of carriage 10 includes a generally flat contact strip 16 having a number of contact pads 80 for providing an electrical path between the microprocessor of the printer (not shown) and the resistors in the printhead (not shown), via an interconnect strip 1 (FIG. 3, also commonly referred to as flex cable). In general terms and as understood by persons of ordinary skill in the art, a computer provides a command to the printer via flex cable 1, flex cable 1 is terminated at one end with contact strip 16, which is further configured with a plurality of contact pads 80. When latched, the plurality of contact pads 80 make contact with corresponding pads on the printhead 40. The printhead 40 is further configured with an array of resistors and nozzles which react to the command to eject droplets of ink, corresponding to print characters.

As may be apparent, contact strip 16 may vary in location, shape, and/or size depending on the contact pads of the printhead (not shown). If so, features of the preferred embodiment may be modified without undue experimentation to accommodate same, as further discussed below.

Figure 13:
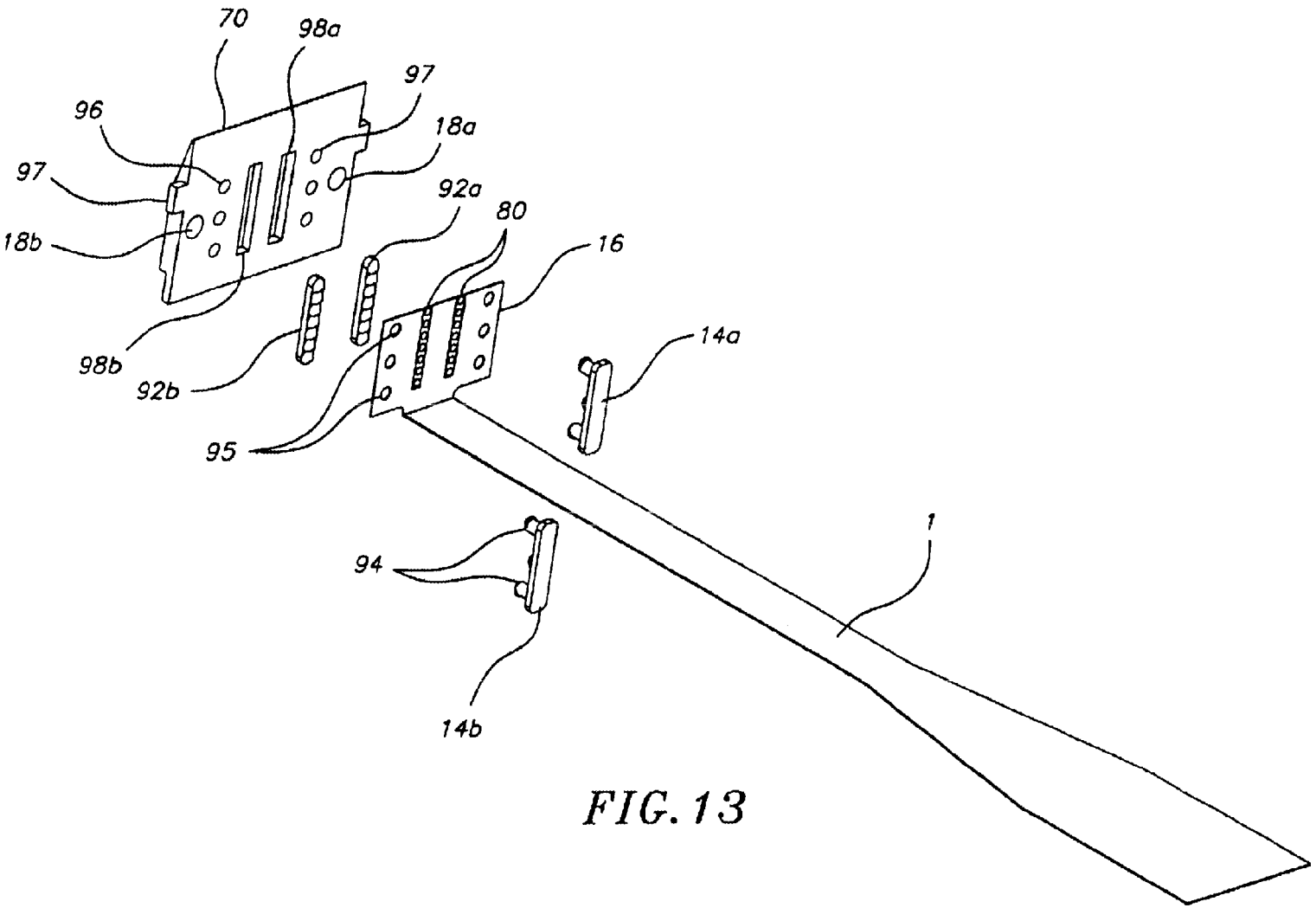
FIG. 13 is a partial exploded isometric view of the carriage front end.

Referring now to FIG. 13 for a fuller explanation of the carriage front end. Preferably, a pair of dielectric strips 92*a*, 92*b* is provided between contact strip 16 and carriage front end 70. Front end 70 includes a pair of recessed channels for matingly receiving said pair of dielectric strips. Contact strip 16 is then placed adjacent front end 70, with a plurality of alignment holes 95 aligned with corresponding registered holes 96, of front end 70. Retaining strips 14*a*, 14*b* are then inserted, via detents 94, into registered holes 96 to secure contact strip 16. Preferably, these retaining strips 14*a*, 14*b* position the contact strip 16 along the inside wall of front end 70 by locking the strip 16 between the retaining strips' bodies and the inside wall of front end 70. In addition, the strips 14*a*, 14*b* are configured so that they sit within two corresponding recesses (not shown) along the cartridge 40 front end 48. As may be apparent by persons of ordinary skill in the art, these strips 14*a*, 14*b* may vary in locations and configurations to coincide with the printhead's recessed surfaces without deviating from the scope of the present invention.

Adjacent the retaining strips 14*a*, 14*b* are guide holes 18*a*, 18*b* (FIG. 13). Preferably, these guide holes 18*a*, 18*b* direct or locate corresponding guide pins from the printhead (not shown) into a ready position for printing. In other words, the mating engagement between the guide pins (of the printhead 40) and guide holes 18*a*, 18*b* (of the carriage 10) secures the front 48 of printhead 40 while latching mechanism 20 secures the back 46 of the printhead 40 (latching mechanism 20 is also commonly referred to as a yoke). As further discussed below, the position and manner in which printhead 40 is locked into position depends on the levers, ears, or tabs provided in the printhead 40. Accordingly, such arrangements may be easily adopted and engaged with without departing from the scope of the invention (similar to the retaining strips 14*a*, 14*b*). Finally, adjacent guide holes 18*a*, 18*b* is another set of tabs 97 for engaging the entire assembled front end with the carriage's body 12, via corresponding engagement slots 61 (best indicated in FIG. 2).

A latching mechanism 20 is included along back wall 72 of carriage 10 (FIGS. 1, 2, and 8–11). The latching mechanism 20 (best indicated in FIGS. 7 and 8) is symmetrical about a vertical centerline of back support plate 38. It includes a pair of actuating arms 22*a*, 22*b*, a pair of cams 30*a*, 30*b*, a pair of locking arms 26*a*, 26*b*, a pair of pivoting rings 34*a*, 34*b*, a pair of locking rings 28*a*, 28*b*, a back support plate 38, and a lever 24. However, as apparent to persons of ordinary skill in the art, the latching mechanism may be modified to be non-symmetrical, to include one or more cams, to engage with a single detent, etc. All variations are contemplated within the scope of the invention so long as they have the same or equivalent features and utilities as discussed below.

Figure 2:
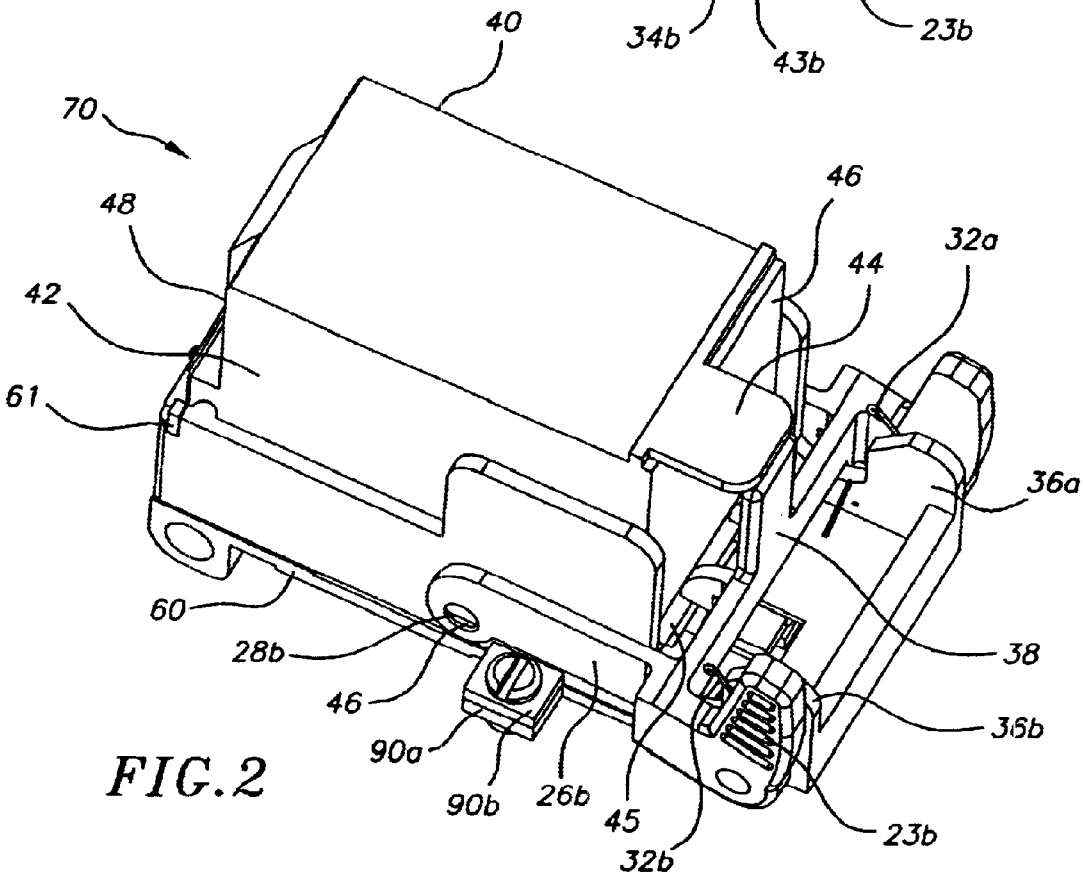
FIG. 2 is similar to FIG. 1, but with a printhead in a latched position.

Preferably in one typical application, after the printhead 40 is lowered into position, inside chute 8 (FIG. 1) and lever 24 is pushed from a first position, the latching means 20 rotates about pivoting rings 34*a*, 34*b* and pivoting tabs 43*a*, 43*b*, which are located on carriage body_12. As the latching means 20 continues its rotation, the cams 30*a*, 30*b* make contact with the backside 46 of printhead 40 (FIGS. 2 and 6). The cams 30*a*, 30*b* are preferably configured so that as the latching means 20 continues its rotation, the cams push the printhead 40 forward in a first direction. By corresponding axial movement, the pair of guide pins (in the front 48 of printhead 40) similarly slide forward through the pair of guide holes 18*a*, 18*b*, along front end 70 of carriage 10. Preferably as this rotation continues, back plate 38 begins to bend and creates a bending force as it tries to revert back to its unbent position. This in turn, provides a bending force that is equal to and opposite the bending force of back plate 38, and is preferably sufficient in force to push printhead 40 forward. Referring to FIG. 6, this arcuate configuration is created in part by the distance between the inside wall of front end 70 to the tip of cams 30*a*, 30*b* being somewhat less than the distance between the printhead front wall 48 and back wall 46.

When latching mechanism 20 makes its complete rotation to a second position, locking rings 28*a*, 28*b* engage and snap with corresponding tabs or ears 4*a*, 4*b* of carriage body 12, and lock latching means 20 in position (See FIGS. 2 and 6).

The interactions of locking rings 28*a*, 28*b* and ears 4*a*, 4*b* (also referred to as detent means) when they snap together ensures that latching means 20 stays in its locked second position until released. In this latching mechanism 20 second position, the cams 30*a*, 30*b* push down on the 45 ledge of the print head 40 to thereby push the print head in a second direction, as shown in FIG. 2 and as further discussed below. Thus, the cams 30*a*, 30*b* are configured to push the printer cartridge axially in a first direction and fixedly in a second direction to thereby secure the cartridge in a ready position.

Although described as a pair of rings and tabs, persons of ordinary skill in the art will understand that pivoting rings 34*a*, 34*b* and pivoting tabs 43*a*, 43*b* may be modified without deviating from the scope of the present invention. By way of examples, pivoting rings 34*a*, 34*b* may be open (i.e., not a full circle) so that they snap into corresponding tabs 43*a*, 43*b* (rather than come over); instead of two separate tabs 43*a*, 43*b*, there could be a long rod; and instead of two pivoting rings 34*a*, 34*b*, latching mechanism 20 may be modified to have a generally planar edge with a series of detent means to snap over the long rod.

Preferably, when the locking arms 26*a*, 26*b* (FIGS. 1 and 2) rotate pass the ears 4*a*, 4*b* to be in the locked position, locking arms 26*a*, 26*b* flex outward to pass over and encompass the ears. In that regard, it is preferable that the ears slope in the direction of the locking rotation to create a ramp-like structure. Alternatively, the ears or tabs 4*a*, 4*b* can be flat. If so, latching means 20 is preferably squeezed about actuating arms 22*a*, 22*b* in order to travel over and encompass the ears 4*a*, 4*b*. The squeezing action creates a moment force about the centerline of lever 24, which in turn causes support plate 38 to bow in the direction of the printhead. Because they are attached to the support plate 38, the locking arms 26*a*, 26*b* similarly move a proportionate angle to the bowed support plate 38. This motion creates a desired clearance for the arms 26*a*, 26*b* to pass over the ears 4*a*, 4*b*.

As will be understood by persons of ordinary skill in the art, when a larger body (i.e., the printhead) is encased by a somewhat smaller frame (i.e., the carriage), at least one of the following typically happens: either the smaller frame flexes and stretches to accommodate the larger body, the larger body compresses to conform to the smaller frame, or both. In the preferred embodiment, the carriage flexes as indicated above.

In the preferred embodiment, the latching force or reliance of the latch is determined in part by ribs 50, 52 (FIG. 7). These ribs 50,52 are configured along back plate 38 to strengthen latching mechanism 20 and to set the amount of flex or pressure the cams 30*a*, 30*b* and backplate 38 exert on printhead 40, as latching mechanism 20 is rotated to the locked second position. The number of ribs, width, and thickness of the ribs are also factors in the amount of flex back plate 38 experiences. As would be understood by persons of ordinary skill in the art, the higher the number or the bigger the ribs, the less back plate 38 flexes, but with a correspondingly higher force. In the preferred embodiment, the ribs 50, 52 are configured with sufficient rigidity so that when bent, an adequate force is generated to secure the printhead, but without requiring undue pressure on the user or back plate 38 to lock the engagement detents.

Alternatively, the flexing may be varied by configuring backplate 38 with no ribs 50, 52, by modifying the cams 30*a*, 30*b* to separately compress (such as using soft rubber or a combination of plastic and rubber), by adding additional flexible materials along front end 70 of carriage 10, etc. These and other equivalent structures and methodologies are understood to fall within the scope of the present invention.

To remove printhead 40 from its ready position or secured position (e.g., to replace printhead 40), as indicated in FIGS. 2, 6, and 12, locking means 28*a*, 28*b* must be disengaged (FIG. 2). The means for carrying out this function is actuating arms 23*a*, 23*b*, or similar structures. Preferably, this is performed by squeezing actuating arms 22*a*, 22*b* at or near their respective gripping surfaces 23*a*, 23*b*. Squeezing at that point causes the rings 28*a*, 28*b* to flex outwards from the detents, which in turn causes them to become disengaged. Although indicated as a series of raised surfaces, gripping surfaces 23*a*, 23*b* are optional. However, from an aesthetic stand point, they are preferable and add to the appearance of latching mechanism 20. From a utility stand point, they may also signify a location to be "squeezed", and are therefore preferable.

When actuating arms 23*a*, 23*b* are squeezed (preferably by the thumb and the index finger), a moment force is generated. This moment force is preferably greater than the modulus of elasticity of back plate 38 and therefore flexes back plate 38, which in turn flexes locking rings 28*a*, 28*b* outwards effecting their disengagement. Because back plate 38 touches printhead 40 at the two cam locations, it flexes or bends, predominantly, at two locations: the section to the right of cam 30*a* and to the left of cam 30*b* (best seen in FIG. 2). Unlike the scenario where the actuating arms 23*a*, 23*b* are squeezed to snap locking means 28*a*, 28*b* in place (as earlier discussed wherein back plate 38 bends approximately about the centerline), here, the bending occurs to the right of cam 30*a* and left of cam 30*b*. This is because the contact points between the two cams 30*a*, 30*b* and printhead 40 reinforces the section between the two cams, thereby limiting that section's bending capability. Because of the described flexing, latching means 20 can be said to have multiple pivoting sections (about pivoting rings 34*a*, 34*b*, and back plate 38). Alternatively, locking arms 26*a*, 26*b* may be configured with additional ears adjacent locking rings 28*a*, 28*b* to provide leverage for disengaging the detents.

Disengagement of latching mechanism 20 may further be assisted by a pair of springs 32*a*, 32*b* (FIG. 2). Although not necessary for the operation of the carriage 10, the springs 32*a*, 32*b* are configured to compress in the ready second position so that when locking means 28*a*, 28*b* are released, the springs unload and push latching mechanism 20 back to the first position as the springs uncoil back to their natural open position (as indicated in FIG. 1).

The force necessary to secure printhead 40 in the ready position is generated in part by the interactions of the cams 30*a*, 30*b*, of the locking rings 28*a*, 28*b*, and of tab or ledge 45 (of printhead 40, best seen in FIG. 2). In the horizontal direction (FIG. 6), this axial force is created by the arcuate back plate 38, and is maintained in part by the engagement of pivoting means 34*a*, 34*b* and of pivoting tabs 43*a*, 43*b* (FIGS. 2, 5), as earlier discussed.

In the vertical direction, a vertical force is generated when the edge of cams 30*a*, 30*b* make contact with ledge 45 (FIG. 2) of printhead 40. Because for every action there is an equal and opposite action, ledge 45 pushes back against the cams 30*a*, 30*b*, to thereby cause latching mechanism 20 to spring open. To prevent this natural tendency to unlatch and to ensure that latching mechanism 20 stays in the ready position, locking rings 28*a*, 28*b* are provided to secure the printhead 40 about the ears 4*a*, 4*b* (as fully discussed above). Although this preferred locking mechanism is disclosed, persons of ordinary skill in the art will understand that other locking or securing devices may be used without deviating from the scope of the invention, including using only a single engagement means, a tongue and groove engagement, a hook, etc.

Figure 10:
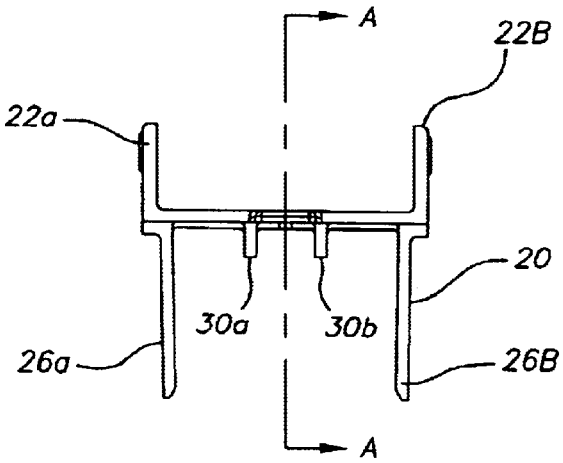
FIG. 10 is a top plan view of FIG. 7.
Figure 11:
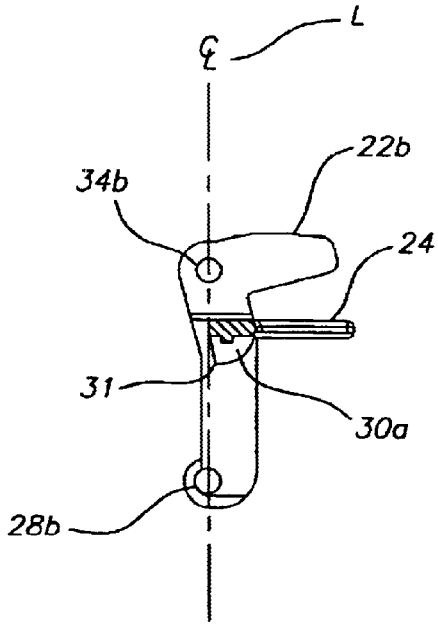
FIG. 11 is a cross-sectional view taken along reference line A—A of FIG. 10.
Figure 12:
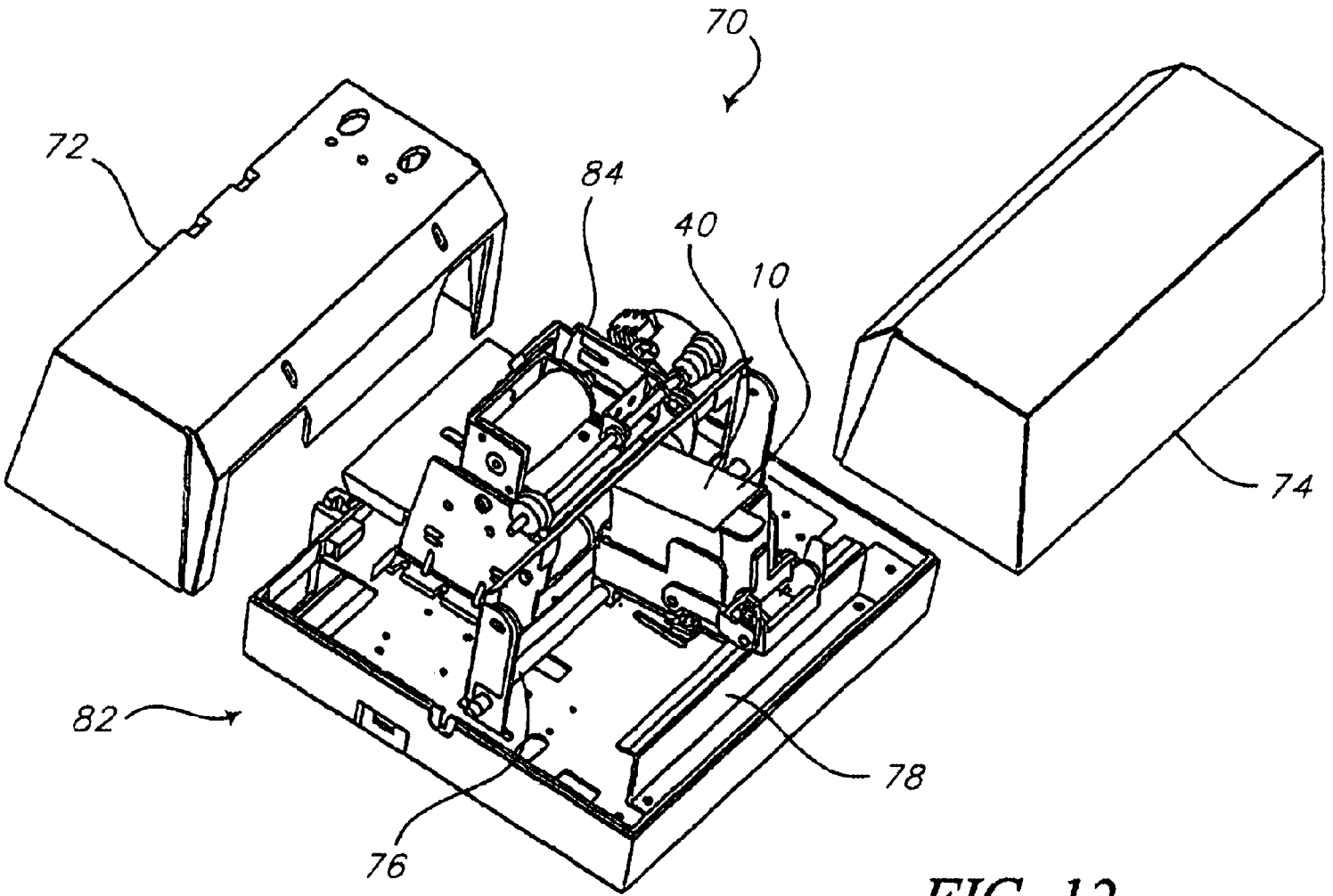
FIG. 12 is an isometric view of a sample printer employing the preferred latching mechanism, and with the front and rear panels removed.

The interactions between the cams 30*a*, 30*b*, pivoting rings 34*a*, 34*b*, and locking rings 28*a*, 28*b* are best understood by referring to FIGS. 10 and 11. As FIG. 11 shows, the centerline L between pivoting ring 34*b* and locking ring 28*b* is somewhat lower than the tip 31 of cam 30*a*. Among other things, this offset arrangement allows the cam to exert the necessary force on ledge 45 of printhead 40 to keep same from moving from the ready or secured position. In the preferred embodiment, tip 31 is slightly lower than the top of ledge 45, when viewed from the perspective of centerline L, to create the necessary down force.

Although the preferred embodiment of the invention has been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims.

What is claimed is:

1. A printer carriage comprising a body defining a chute for receiving a printer cartridge, a pivot member on the body for pivot communication with a latching mechanism, wherein the latching mechanism comprises at least one cam, a detent means, and a pivoting receiver for pivot communication with the pivot member on the body, wherein the pivoting receiver rotates about the pivot member to impart motion to the at least one cam, and wherein the at least one cam pushes the printer cartridge axially in a first direction against a first surface and holds the printer cartridge fixedly in a second direction against a second surface to secure the printer cartridge in a ready position, and wherein the detent means engages with a portion of the body to hold the printer cartridge in the ready position.

2. The carriage of claim 1, further comprising a lever on the latching mechanism, the lever is configured for manipulating by a user to move the printer cartridge in the ready position.

3. The carriage of claim 1, wherein the at least one cam, the detent means, and the pivoting receiver are positioned on the latching mechanism on more than one plane.

4. The carriage of claim 1, further including a back plate, the back plate is configured to bend when the at least one cam makes contact with the cartridge.

5. The carriage of claim 4, further including ribs for reinforcing the back plate.

6. The carriage of claim 1, further including at least one spring, the at least one spring is configured to push the cam from the ready position to a first position.

7. The carriage of claim 1, further including an actuating means for disengaging the detent means.

8. The carriage of claim 1, further including an actuating means implemented by squeezablc tabs for disengaging the detent means.

9. A printer carriage for,housing a cartridge inside a printer, said carriage comprising a body defining a chute and a latching mechanism for securing said cartridge with said chute; said carriage including a tab for locking engagement with said latching mechanism; said latching mechanism including at least one cam positioned on a support plate, at least one locking means for locking engagement with said tab, at least one actuating arm for releasing said locking means from said tab to relcase said latching mechanism from said body and at least one pivoting means, for rotating said latching mechanism from a first position lo a second position about a pivoting axis, such that said cam pushes said cartridge into a ready position with said chute.

10. The carriage of claim 9, wherein the printer is an inkjet printer.

11. The carriage of claim 9, wherein the pivoting means, comprises a pivot ring.

12. The carriage of claim 9, further including a lever extending from said support plate, said lever is configured to push and move said latching mechanism from said first position to said second position.

13. The carriage of claim 9, further including ribs integrally molded with said support plate.

14. The carriage of claim 9, further including at least one spring, said at least one spring is configured to compress when in said second position.

15. The carriage of claim 9, wherein said pivoting means comprises a pivot pin.

16. A printer cartridge holder comprising:

a housing having a cavity adapted to receive a printer cartridge;

a latch, pivotally attached to the housing, that is movable relative to the housing, the latch having a first position in which the cartridge is latched in the cavity and a second position in which the cartridge is removable from the cavity;

a cam movable with the latch such that the cam engages and urges the cartridge into the cavity in the first position and such that the cam disengages and frees the cartridge so the cartridge can move out of the cavity in the second position;

means for securing the latch in the first position;

means for releasing the latch from the first position so the latch can be moved to the second position; and wherein the latch comprises a yoke having opposite arms that fit around the housing and the securing means comprises openings in the opposite arms and detents positioned on the housing to capture the openings in the first position.

17. The printer cartridge holder of claim 16, in which the releasing means comprises opposite ears formed on the yoke configured to move the detents out of the openings when squeezed together.

18. The printer cartridge holder of claim 17, in which a tab is formed on the yoke to swing the yoke toward the second position responsive to finger movement.

19. The printer cartridge holder of claim 18, in which the cam is arranged to lift the cartridge out of the cavity in the second position.

20. A printer cartridge holder comprising:

a housing having a cavity adapted to receive a printer cartridge having one or more electrical contacts;

a latch that is movable relative to the housing, the latch having a first position in which the cartridge is latched in the cavity, a second position in which the cartridge is removable from the cavity, and a pair of actuating arms for releasing the latch from the first position;

one or more electrical contacts mounted on the housing so as to establish an electrical connection with the contacts on the cartridge when the latch is in the first position;

a cam movable with the latch such that the cam engages and urges the cartridge into the cavity in the first position and such that the cam disengages and frees the cartridge so the cartridge can move out of the cavity in the second position;

means for securing the latch in the first position; and means for releasing the latch from the first position so the latch can be moved to the second position, and wherein the means for releasing the latch comprises said pair of actuating arms.

21. The holder of claim 20, in which the cam is adapted to drive the contacts of the cartridge toward the contacts of the housing.

22. The holder of claim 20, further comprising a cam first surface and a cam second surface, wherein the cam first surface is adapted to engage and move the printer cartridge into the first position and the cam second surface is adapted to urge and hold the printer cartridge in the first position.

23. The holder of claim 20, wherein the housing further comprises a guide hole and wherein the guide hole is adapted to receive a portion of the printer cartridge to guide the printer cartridge into position for electrical connection with the housing.

24. The holder of claim 20, further comprising a lever for pushing the latch in the first position.

25. The holder of claim 20, further comprising a resilient member for urging the lever in the second position.

* * * * *